US006786841B1

(12) United States Patent
Dixon

(10) Patent No.: US 6,786,841 B1
(45) Date of Patent: Sep. 7, 2004

(54) HAND-HELD BALL HITTING TRAINING DEVICE

(76) Inventor: Nicholas E. Dixon, NEDCO Sports Products, Inc., 5315 U.S. Hwy. 431, Albertville, AL (US) 35950

( * ) Notice: Subject to any disclaimer, the term of this patent is extended or adjusted under 35 U.S.C. 154(b) by 0 days.

(21) Appl. No.: 10/341,795

(22) Filed: Jan. 13, 2003

Related U.S. Application Data

(60) Provisional application No. 60/348,823, filed on Jan. 14, 2002.

(51) Int. Cl.[7] ..... A63B 69/40
(52) U.S. Cl. ..... 473/451; 473/424
(58) Field of Search ..... 473/451, 417, 473/422, 424, 425, 453, 430, 458

(56) References Cited

U.S. PATENT DOCUMENTS

| | | | | | |
|---|---|---|---|---|---|
| 2,396,408 | A | * | 3/1946 | Benecke | 473/234 |
| 2,765,170 | A | * | 10/1956 | Brown | 473/424 |
| 3,921,976 | A | * | 11/1975 | Lane | 473/458 |
| 4,042,237 | A | * | 8/1977 | Moraru | 473/429 |
| 4,846,472 | A | * | 7/1989 | Terza | 473/424 |
| 5,011,145 | A | * | 4/1991 | Bartkowicz | 473/568 |
| D328,935 | S | | 8/1992 | Dixon, Jr. | D21/210 |
| 5,230,506 | A | * | 7/1993 | Cipriano et al. | 473/424 |
| 5,492,321 | A | * | 2/1996 | Cipriano | 473/424 |
| 5,531,438 | A | * | 7/1996 | Corley | 473/429 |
| 5,618,039 | A | * | 4/1997 | Tsai et al. | 473/423 |
| 5,755,631 | A | * | 5/1998 | Paschka | 473/459 |
| D411,862 | S | * | 7/1999 | Greene | D21/698 |
| D413,641 | S | | 9/1999 | Falco | D21/725 |
| 6,458,037 | B1 | * | 10/2002 | Dixon, Jr. | 473/219 |

* cited by examiner

*Primary Examiner*—Stephen P. Garbe
*Assistant Examiner*—Nini F. Legesse
(74) *Attorney, Agent, or Firm*—John R. Flanagan

(57) ABSTRACT

A hand-held ball hitting training device includes a resilient semi-flexible rod bendable upon impact by a bat, a handle component attached on one opposite end of the rod, a ball simulation component attached on the other opposite end of the rod, a hand grip-defining sleeve disposed about the handle component and captured between outer and inner annular collars formed thereon, a securement element fitted over the rod and adjacent to the inner collar of the handle component and having a longitudinal split in a side thereof, and an anchor strap having a first loop portion fitted about the handle component adjacent to the inner collar and seated in an annular recess in the handle component and under the securement element and a second loop portion attached to the first loop portion and extending outwardly therefrom through the split in the securement element.

17 Claims, 3 Drawing Sheets

HAND-HELD BALL HITTING TRAINING DEVICE

This patent application claims the benefit of U.S. provisional application No. 60/348,823, filed Jan. 14, 2002.

BACKGROUND OF THE INVENTION

1. Field of the Invention

The present invention generally relates to a device for use in hitting or batting practice and, more particularly, is concerned with a hand-held ball hitting training or practice device.

2. Description of the Prior Art

A simple, low-cost and easy-to-use batting or hitting practice device is needed, especially, for young ball players to employ to improve their ball hitting skills. Such a device which would permit a player to perform many practice swings in a short period of time would be particularly beneficial for players to use during pre-game warm-up for achieving a more productive hitting practice in a short period of time. Also, such a device which would permit a coach to closely observe players' swings would be highly advantageous.

A suitable hitting practice or warm-up device is the one invented by Nicholas E. Dixon, the inventor of the invention disclosed in the subject application. The Dixon prior art device, disclosed in U.S. Pat. No. Des. 328,935 issued on Aug. 25, 1992, permits two players to practice hitting using the device with one player using a bat and the other player holding the device. Over the years, this prior art device has proven to be highly satisfactory and advantageous during use for its intended purposes However, as with any device, a need is seen for innovations from time to time which will further improve the device.

SUMMARY OF THE INVENTION

The present invention provides a hand-held ball hitting training device designed to satisfy the aforementioned need. The device of the present invention incorporates innovations which are believed to improve its production and long-term durability.

Accordingly, the present invention is directed to a hand-held ball hitting training device which comprises: (a) an elongated resilient rod semi-flexible and bendable upon impact by a bat with the device, the elongated rod having opposite ends; (b) a handle component attached on one of the opposite ends of the rod, the handle component having outer and inner annular collars formed thereon and thereabout and axially displaced from one another along the handle component; (c) a ball simulation component attached on the other of the opposite ends of the rod; and (d) a hand grip-defining sleeve disposed about the handle component and captured between the outer and inner annular collars on the handle component.

More particularly, the device further comprises a securement element and an anchor strap. The securement element is made of resiliently flexible material and has a central opening receiving the rod therethrough such that the securement element is fitted over the rod and disposed adjacent to the inner collar. The handle component has an annular recess formed therein adjacent to the inner collar. The securement element is seated in the annular recess in the handle component. The securement element has a longitudinal split in a side thereof extending between its opposite ends. The anchor strap has a first loop portion fitted about the handle component adjacent to the inner collar and positioned under the securement element and a second loop portion for encircling one of the hands of a player and being larger than the first loop portion and attached thereto and extending outwardly therefrom through the split in the securement element.

Further, the ball simulation component has a rounded end portion simulating a ball and an elongated neck portion merging from the rounded end portion and extending along the rod. The device also includes a user's sight-enhancing sleeve disposed over the elongated neck portion of the ball simulation component adjacent to the rounded end portion thereof. The sight-enhancing sleeve is of a different color than the rounded end portion of the ball simulation component.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
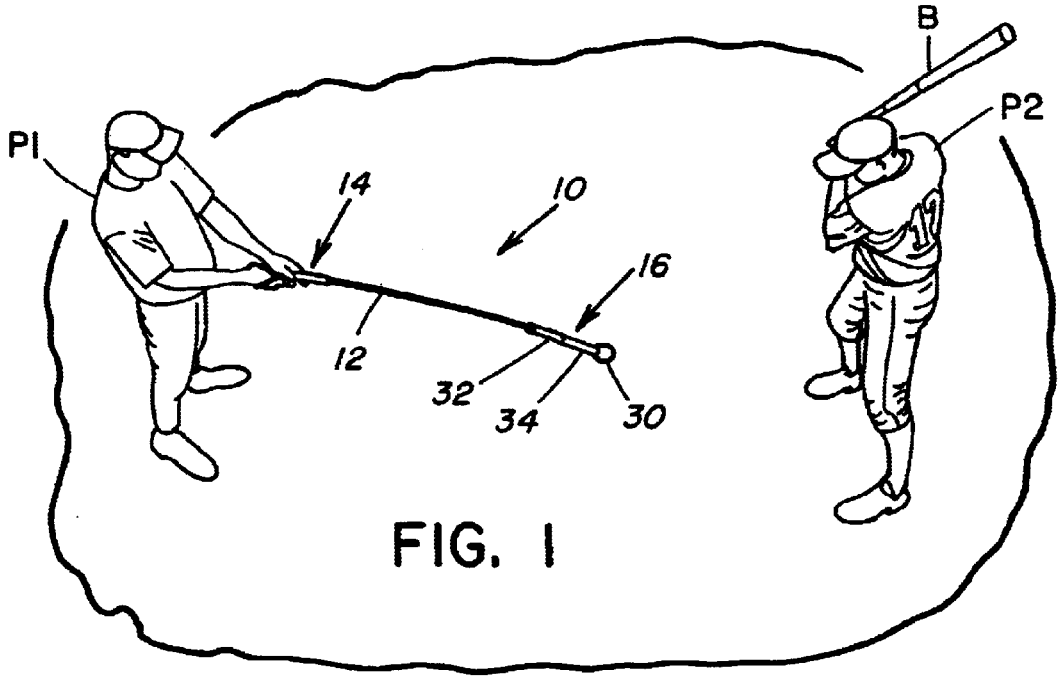
FIG. 1 is a top view of two players during hitting practice employing a hand-held ball hitting training device of the present invention.

Referring to the drawings and particularly to FIG. 1, there is illustrated a hand-held ball hitting training device, generally designated 10, of the present invention. A first player P1 holds the ball hitting practice device, generally designated 10, while a second player P2 takes warm-up or practice hitting by swinging a bat B at the end of the device 10. After the second player P2 has taken a sufficient number of practice swings, the first player P1 can then switch roles with the second player P2 and take a number of practice swings at the end of the device 10. Also, instead of a player, more advantageously the person holding the device 10 can be a coach who is able to hold the device 10 while closely observing the batter's form. The coach can then make suggestions for how the batter can improve his or her technique as the training session progresses.

Figure 2:
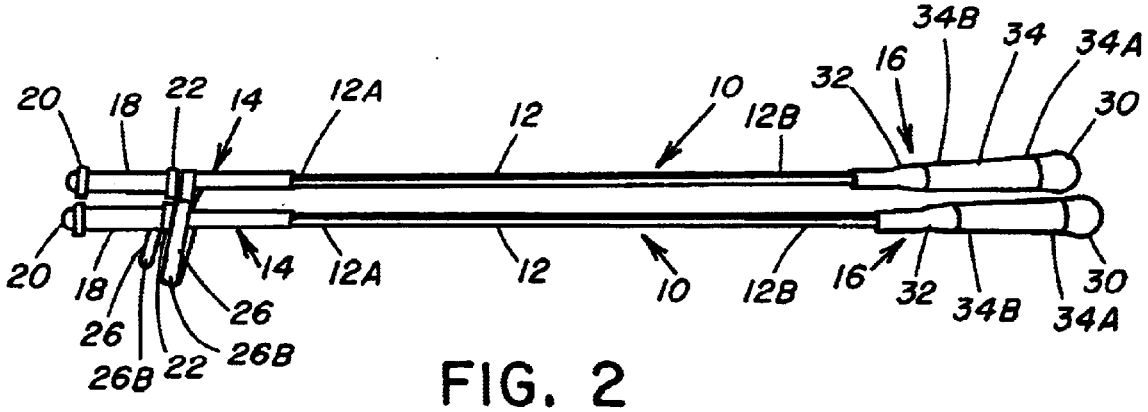
FIG. 2 is a side elevational view of two of the ball hitting training devices having different lengths.
Figure 3:
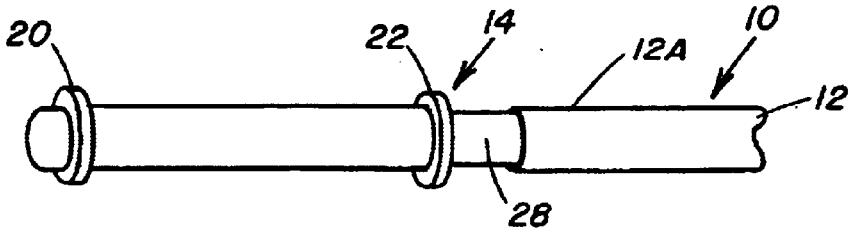
FIG. 3 is an enlarged fragmentary side elevational view of a handle component on one opposite end of an elongated rod of the ball hitting training device showing axially spaced inner and outer annular collars on the handle component and with a hand grip-defining component removed.
Figure 4:
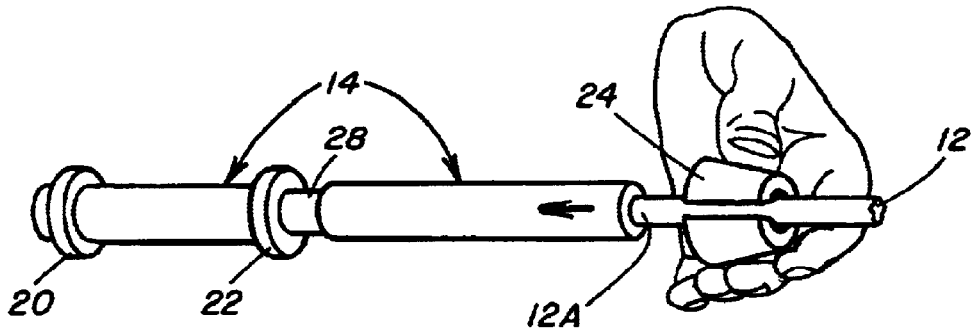
FIG. 4 is a view similar to that of FIG. 3 now showing a securement or ramp element being slid along the elongated rod of the device toward the handle component.
Figure 5:
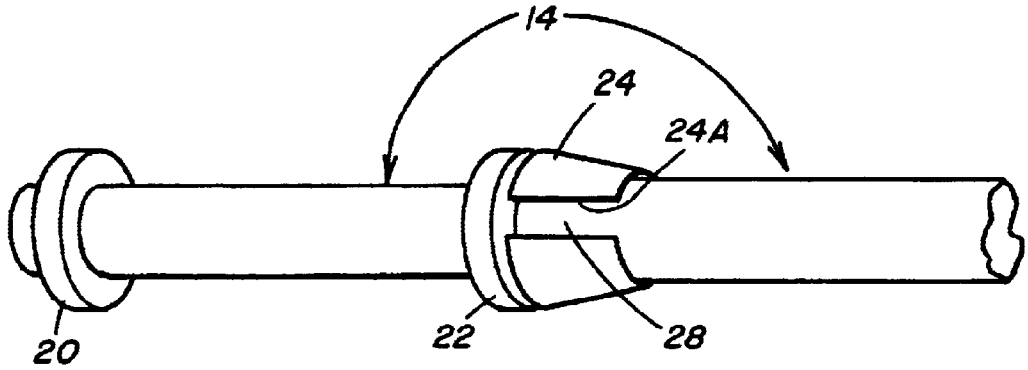
FIG. 5 is a view similar to that of FIG. 4 now showing the ramp element seated in the annular recess formed about the handle component adjacent to the inner collar.
Figure 6:
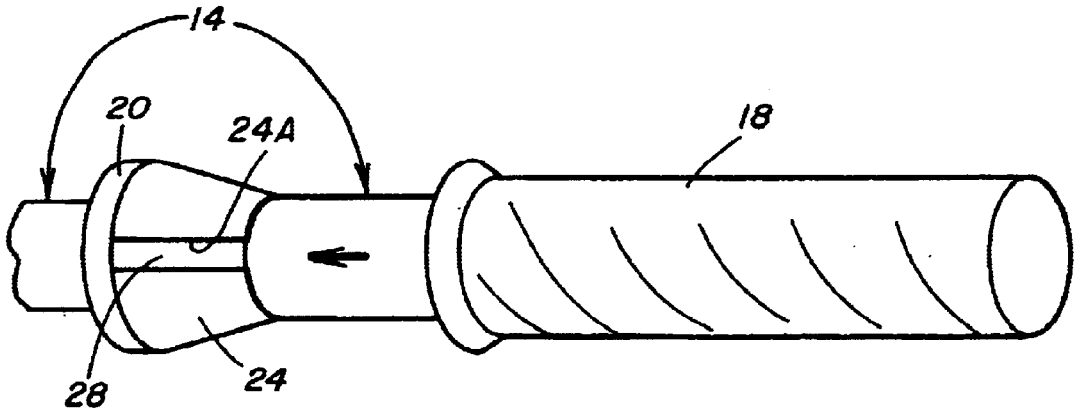
FIG. 6 is a view similar to that of FIG. 5 now showing the hand grip-defining component being installed over the handle component.
Figure 7:
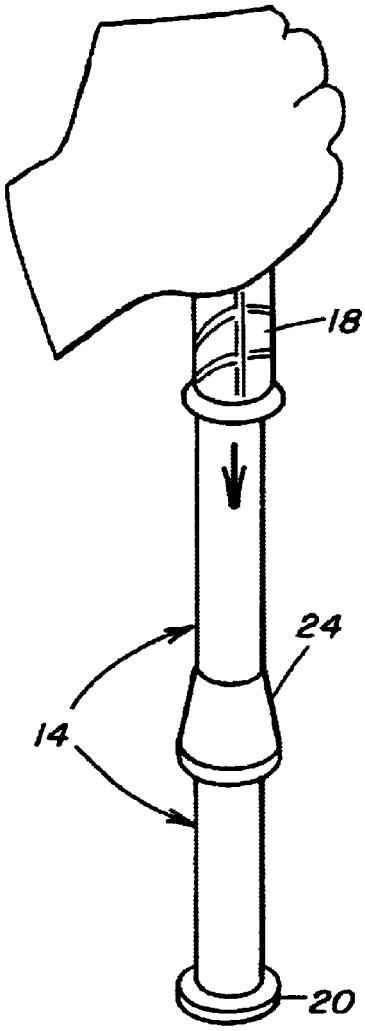
FIG. 7 is another view showing the hand grip-defining component being installed over the handle component.
Figure 10:
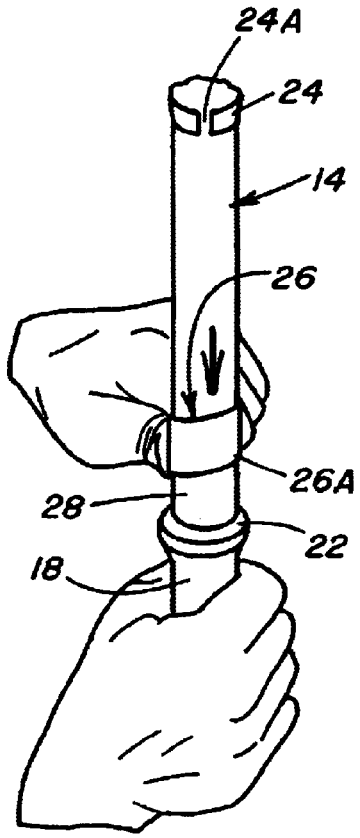
FIG. 10 is a view similar to that of FIG. 4 now showing an anchor strap being installed on the handle component of the device.

Referring to FIG. 2, there is shown two of the ball hitting practice devices 10 of different lengths. The longer two (for example, 58 inches in length) of the devices 10 are for adults to use in baseball and softball practice hitting. The shorter two (for example, 53 inches in length) of the devices 10 are for youth to use in baseball and softball practice hitting.

Referring to now FIGS. 3–11, the ball hitting practice device 10 basically includes an elongated resilient rod 12, a handle component 14, a ball simulation component 16 and a removable or replaceable hand grip-defining sleeve 18. The elongated resilient rod 12 is made of a semi-flexible material, such as a suitable plastic, which is bendable upon impact by the bat B with the device 10. The elongated resilient rod 12 has a pair of spaced apart opposite ends 12A, 12B. The handle component 14 is attached, such as being formed or interfitted, on the one opposite end 12A of the rod 12. The handle component 14 has outer and inner annular collars 20, 22 formed thereon and thereabout and axially displaced from one another along the handle component 14. The ball simulation component 16 is attached, such as being formed or interfitted, on the other opposite end 12B of the rod 12. The hand grip-defining sleeve 18 is applied about the handle component 14 and disposed and captured between the outer and inner annular collars 20, 22 on the handle component 14.

The ball hitting practice device 10 also includes a split wedge securement or ramp element 24 and an anchor strap 26. The ramp element 24, made of resiliently flexible material and of conical shape, fits over the rod 12 and is slid along the rod 12 to a position against the inner collar 22 and seated in an annular recess 28 defined in the handle component 14 adjacent to the inner collar 22. The conical ramp element 24 facilitates the installation of the hand grip-defining sleeve 18 over the inner collar 22 by causing a gradual expansion of the diameter of the sleeve 18 as it is slidably forced toward the ramp 24 and over the inner collar 22. Once the sleeve 18 is past the inner collar 22 the sleeve 18 returns to its normal contracted condition in which it snugly fits about the handle component 14 between the outer and inner collars 20, 22. The ramp element 24 has a longitudinal split or slot 24A in one side thereof. The hand grip-defining sleeve 18 preferably is made of a suitable anti-shock or absorbing material.

The anchor strap 26 has a small diameter loop portion 26A which is snugly fitted about the handle component 14 and positioned under the ramp element 24. The anchor strap 26 also has a large diameter loop portion 26B which is attached to the small diameter loop portion 26A and extends outwardly therefrom through the slot 24A in the ramp element 24. As shown in FIGS. 1 and 2, the large diameter loop portion 28B of the anchor strap 26 encircles one of the hands of the player holding the device 10.

Figure 11:
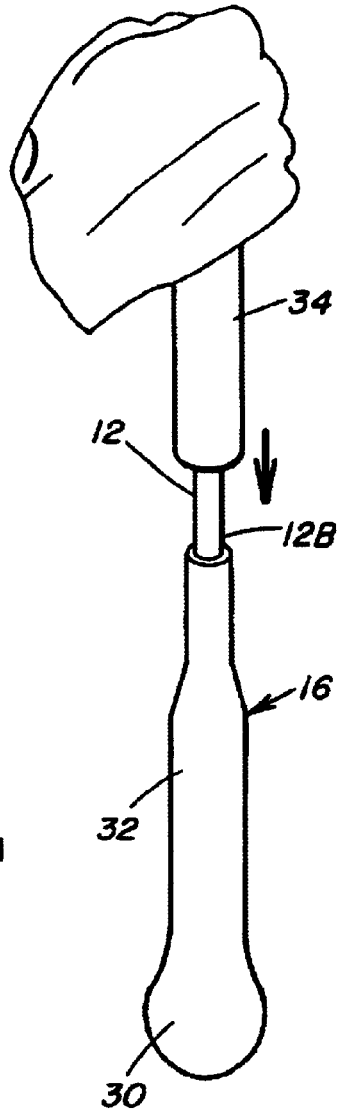
FIG. 11 is an enlarged fragmentary side elevational view of the other opposite end of the elongated rod of the device showing a ball simulation component thereon and a sight-enhancing sleeve being installed over a neck portion of the ball simulation component.
Figure 8:
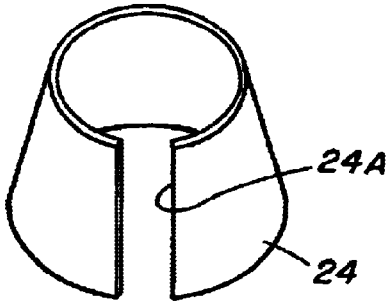
FIG. 8 is a perspective view of the ramp component.
Figure 9:
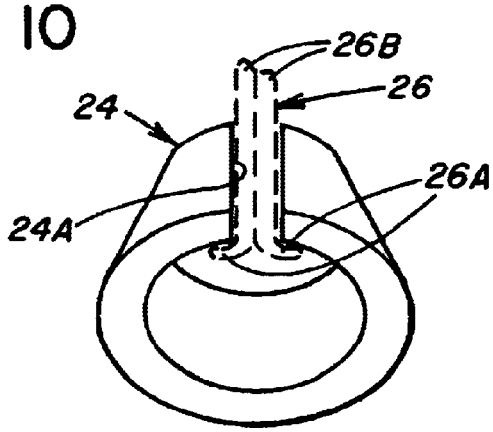
FIG. 9 is another perspective view of the ramp component with a portion of an anchor strap shown in dashed line form disposed in installed relationship thereto.

The ball simulation component 16 on the one end 12B of the rod 12 of the device 10 has a rounded end portion 30 simulating a ball and an elongated neck portion 32 which merges from the rounded end portion 30 extending along the rod 12. The device 10 further includes a user's sight-enhancing sleeve 34, as seen in FIGS. 2 and 11, which is snugly fitted over the elongated neck portion 32 of the ball simulation component 16. The leading end 34A of the sight-enhancing sleeve 34 next to the rounded end portion 30 is smaller in thickness than the trailing end 34B of the sight-enhancing sleeve 34. The sight-enhancing sleeve 34 is preferably a different color, and one that is highly contrasting, compared to the color of the rounded end portion 30 of the device 10. This allows the batter to more easily focus on the rounded end portion 30 or ball, thereby improving his or her optical concentration skills.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A hand-held ball hitting training device, comprising:

(a) an elongated resilient rod semi-flexible and bendable upon impact by a bat with the device, said elongated rod having opposite ends;

(b) a handle component attached on one of said opposite ends of said rod, said handle component having outer and inner annular collars formed thereon and thereabout and axially displaced from one another along said handle component;

(c) a ball simulation component attached on the other of said opposite ends of said rod;

(d) a hand grip-defining sleeve disposed about said handle component and captured between said outer and inner annular collars on said handle component; and (e) a securement element made of resiliently flexible material and having a central opening receiving said rod therethrough such that said securement element is fitted over said rod and disposed adjacent to said inner collar.

2. The device of claim 1 wherein said ball simulation component on said one of said opposite ends of said rod has a rounded end portion simulating a ball.

3. The device of claim 2 further comprising:

a sight-enhancing sleeve disposed over a portion of said ball simulation component and adjacent to said rounded end portion thereof.

4. The device of claim 3 wherein said sight-enhancing sleeve is of a different color than said rounded end portion of said ball simulation component.

5. The device of claim 2 wherein said ball simulation component also has an elongated neck portion which merges from said rounded end portion and extends along said one of said opposite ends of said rod.

6. The device of claim 5 further comprising:

a sight-enhancing sleeve disposed over said elongated neck portion of said ball simulation component and adjacent to said rounded end portion thereof.

7. The device of claim 6 wherein said sight-enhancing sleeve is of a different color than said rounded end portion of said ball simulation component.

8. The device of claim 1 wherein said handle component has an annular recess formed therein adjacent to said inner collar, said securement element being seated in said annular recess in said handle component.

9. The device of claim 8 wherein said securement element has a longitudinal split in a side thereof extending between opposite ends of said securement element.

10. The device of claim 9 further comprises:

an anchor strap having a first loop portion fitted about said handle component adjacent to said inner collar and positioned under said securement element, said anchor strap also having a second loop portion for encircling one of the hands of a player and being larger than said first loop portion and attached thereto and extending outwardly therefrom through said split in said securement element.

11. A hand-held ball hitting training device, comprising:

(a) an elongated resilient rod semi-flexible and bendable upon impact by a bat with the device, said elongated rod having opposite ends;

(b) a handle component attached on one of said opposite ends of said rod, said handle component having outer and inner annular collars formed thereon and thereabout and axially displaced from one another along said handle component;

(c) a ball simulation component attached on the other of said opposite ends of said rod;

(d) a hand grip-defining sleeve disposed about said handle component and captured between said outer and inner annular collars on said handle component, said sleeve being made of a resilient material permitting expansion of said cross-sectional size of said sleeve; and (e) a ramp element made of resiliently flexible material and having a central opening receiving said rod therethrough such that said ramp element is fitted over said rod and disposed adjacent to said inner collar, said conical ramp being conical in shape enabling installation of said hand grip-defining sleeve over said inner collar by causing an expansion of said cross-sectional size of said sleeve from an initial contracted condition as said sleeve is slidably forced toward said ramp and over said inner collar such that once said sleeve is past said inner collar said sleeve returns to said contracted condition in which said sleeve fits about said handle component between said outer and inner collars.

12. The device of claim 11 wherein said handle component has an annular recess formed therein adjacent to said inner collar, said ramp element being seated in said annular recess in said handle component.

13. The device of claim 12 wherein said ramp element has a longitudinal split in a side thereof extending between opposite ends of said ramp element.

14. The device of claim 13 further comprises:

an anchor strap having a first loop portion fitted about said handle component adjacent to said inner collar and positioned under said ramp element, said anchor strap also having a second loop portion for encircling one of the hands of a player and being larger than said first loop portion and attached thereto and extending outwardly therefrom through said split in said ramp element.

15. The device of claim 11 wherein said ball simulation component on said one of said opposite ends of said rod has a rounded end portion simulating a ball.

16. The device of claim 15 further comprising:

a sight-enhancing sleeve disposed over a portion of said ball simulation component and adjacent to said rounded end portion thereof.

17. The device of claim 16 wherein said sight-enhancing sleeve is of a different color than said rounded end portion of said ball simulation component.

* * * * *